US005271518A

United States Patent [19]

Webb

[11] Patent Number: 5,271,518

[45] Date of Patent: Dec. 21, 1993

[54] SUMP COVER

[75] Inventor: Michael C. Webb, Chester Springs, Pa.

[73] Assignee: Environ Products Inc., Lionville, Pa.

[21] Appl. No.: 920,111

[22] Filed: Jul. 24, 1992

[51] Int. Cl.[5] ..... B65D 45/32

[52] U.S. Cl. ..... 220/320; 220/355; 220/358; 220/373; 220/614; 220/617

[58] Field of Search ..... 220/319, 320, 321, 367, 220/373, 610, 611, 614, 617, 622, 623, 355, 358, 308; 215/261

[56] References Cited

U.S. PATENT DOCUMENTS 1,197,924 9/1916 Ellinger ..... 220/320
1,316,285 9/1919 Dister ..... 220/320
1,713,224 5/1929 Gunter ..... 220/319 X
2,298,938 10/1942 Griffin, Jr. et al. ..... 220/373
3,383,006 5/1968 Knize ..... 220/355
4,369,892 1/1982 Uhlig ..... 220/320
4,756,852 7/1988 Temus ..... 215/261 X

*Primary Examiner*—Allan N. Shoap
*Assistant Examiner*—Nova Stucker
*Attorney, Agent, or Firm*—Eugene E. Renz, Jr.

[57] ABSTRACT

A cover for a sump assembly including a riser section of generally tubular configuration comprising a top section and a skirt section depending from the outer periphery of the top section. The skirt section being of a configuration defining a pair of side by side circumferentially extending inner and outer channels which open in opposite axial directions. One of the channels is engageable over a seal mounted on the outer axial end of the riser. A compression ring is engageable in the other channel to produce radially directed sealing forces between the cover and the riser section.

9 Claims, 3 Drawing Sheets

SUMP COVER

FIELD OF THE INVENTION

The present invention relates to improvements in so-called "secondary containment systems" for hydrocarbon storage and delivery systems and more specifically to an improved sump cover assembly for effectively sealing sumps used in secondary containment systems.

BACKGROUND OF THE INVENTION

Consider first a broad overview of the state of the general art to which the present invention relates. In typical underground storage and distribution systems for hazardous fluids such as hydrocarbon fuels, the fuels are usually stored in a large storage tank buried in the ground and delivered through underground piping to delivery pumps or the like. These systems sometimes include a so-called back fill retainer which is simply a round elongated tubular cylinder made of steel which is installed around the pumps and under the street access manhole to maintain back fill materials away from the pump and various plumbing connections.

In recent years there has been an increasing awareness that these primary storage and distribution systems of hazardous fluids need to be contained to prevent product from leaking into the environment to prevent environmental problems such as contamination of public drinking water and making some of the food supply unusable as well as other serious environmental consequences. The Federal Environmental Protection Agency (EPA) has focused on this problem prompting passage of federal and state laws requiring improved means of storage, distribution and leak detection for all stored fluids which are characterized as hazardous. An EPA study concluded that these systems present a hazard to the environment because of poor installation practices, corrosion and structural failures producing leaks contaminating the environment. These laws and regulations have given rise to so-called "secondary containment" systems which essentially provide a second barrier of protection around the primary fluid supply storage and delivery systems.

The secondary containment systems have included access sumps which are an offshoot from the so-called back fill retainer. There are a variety of sumps now on the market usually comprising a base defining an enlarged chamber, a riser connected to the base of smaller diameter and a cover fitting over the top end of the riser which, in some instances, has access openings enclosed by an access lid which provide a means for inspecting the interior of the sump chambers.

These sumps are made from a variety of materials. However, a preferred material is a non-corrodible fiberglass material which is believed to provide advantages over metal containers made of coated steel. These sumps usually house pumps and are usually located at the lowest point of a sloped secondary piping system and thus are a focus of the collection of leaked fluids. These sumps are viewed as a multipurpose chambers and are commonly referred to as "pump access sumps".

Even though the secondary containment systems and detecting means have improved considerably over a relatively short period of time in response to continuously changing environmental and safety regulations and laws, there are still certain component parts and design concepts of these secondary containment systems discussed above which do not provide the optimum solution in developing more fail safe secondary containment systems. For example, even though seals have been utilized between the lip of the sump cover and the top of the riser adjacent the open end, these seals have not proven adequate under extreme conditions to provide a truly water tight or hermetic sump chamber. For example, in areas where the water table is high, the external pressure on the riser often results in a breakage of the seal and migration of fluids into the sump chamber which, of course, is undesirable. Further, the risers are usually of a relatively large diameter and it is difficult to mold fiberglass or polyethylene in a manner to provide a high degree of concentricity between the cover and the riser while still maintaining the economies required for these sump assemblies. It has been found that a certain degree of warpage producing some measure of "out-of-round" is inherent in the manufacturing process.

Consider now more specifically the state of the art. In recent years there has been a public mandate for the protection of our ground water resources. This action has resulted in the Federal Environmental Protection Agency (EPA) issuing strict guidelines for the storage and handling of hazardous liquids. State and local regulatory bodies have also issued regulations which are equal to, or stricter than, those issued by the EPA. Contained within the broad range of regulations are specific requirements that underground pumps and piping connections be provided with a means of secondary containment whereby any leaks in these plumbing connections will be contained and detected by means of a leak sensing device.

As a result of these new regulations, large containment containers have been introduced to the marked called "containment sumps". These multi-purpose containment sumps are typically installed under a conventional street access manhole cover, and are connected at the base to the top of an underground storage tank. The primary function of these containment sumps is to provide a means of secondary containment of the underground storage tanks, submersible pumps, valves, and associated pipe connections. They also serve as a means of keeping back the surrounding ground backfill material and providing a dry working area for routine maintenance and repair. These containment sumps require liquid-tight piping and conduit entries, base and riser connections, and access covers in order to prevent any leaking liquids from escaping, and a means of keeping ground water from entering.

The first containment sumps introduced to the market in the middle 1980's were very limited in design and did not prove to be completely liquid tight. These early models were usually made of fiberglass or corrosion protected steel. Because of the materials used and their design, they were not height adjustable, were difficult to field install and fabricate and provided restrictive pipe and conduit entry capabilities. The one piece construction made the pump and piping installation difficult. Sumps made of coated steel were unpopular because of their potential to fail due to corrosion. The sumps made of rigid fiberglass and steel achieved limited success in providing a liquid tight access cover by means of bolt fasteners and gaskets.

In an effort to provide a containment sump which was easier to install and fabricate, polyethylene containment sumps were introduced in the late 1980's. The sumps were of a two-piece construction with a base section and a height adjustable riser section. This design allowed the tank's pump and plumbing connections to be easily installed into the accessible base section before the upper riser section was installed.

The upper riser section was sized in diameter to be installed inside the lower backfill retainer skirt of the street access manhole. This was a significant improvement because it allowed the sump to move up or down in the manhole skirt during skirt or tank movement, therefore not damaging the sump or the underground storage tank situated under the sump.

The upper riser section was capable of being cut to the required installed height. This height adjustability feature allowed for both deep and shallow tank burial depths. The problem with this two piece base/riser design was that it introduced a new, additional sump connection joint which also had to be liquid tight.

The first polyethylene containment sumps on the market did not have an effective means of sealing the base/riser joint. One such type of two piece sump required that the joint where the riser section made contact with the base section be sealed by means of "speed tip welding". This thermo-plastic welding process required the use of a hot air gun fitted with a special tip on its nozzle which allowed a plastic polyethylene rod to be inserted through an opening in the tip, heated and then melted over the joint area. This welding process proved in the field to be ineffective for untrained personnel. The speed of welding, surface preparation, moisture, and other factors resulted in poor welding applications leading to numerous leaks.

In early 1990 a new sump was introduced to the market to solve the riser/base seal process. This new sump introduced a mechanical means of sealing the riser/base joint by using metal fasteners and a rubber O-ring seal. This required the base of the riser section and the top of the base section to have two inwardly turned flanges with a series of equally spaced bolt holes in both flanges. The rubber O-ring seal was inserted between the bottom portion of the riser flange and the top portion of the base flange on the outside of the fasteners, and they were compressed together by tightening the metal fasteners.

Between 1985 and 1990 another problem with underground containment sumps was beginning to surface. Pipe and conduit entries were difficult and ineffective to seal to the side wall of the containment sump. As a result many containment sumps began to take on water through these ineffectively sealed entries.

Containment sumps which provided fixed pipe and conduit entry locations, such as inwardly and outwardly facing cuffs, proved not to be installation friendly for the installing contractor who was restricted to certain locations for making his pipe and conduit entries. These nonflexible sealed entries not only did not allow the pipe or conduit to accommodate ground movement but they were also ineffective in providing a liquid-tight seal.

Other types of pipe and conduit entry seals were introduced such as a rubber grommet. These seals also failed to be liquid tight because they could not effectively seal angled pipe and conduit entries into the side wall of the containment sump. Additional problems arose such as sealing to a non-flat wall surface, for example in round sumps.

A new product was introduced to the market called a "flexible entry boot" which solved the problem of leaking pipe and conduit entries. This rubber entry boot included mechanical fasteners and was bolted into the side wall of the containment sump. Other design features permitted angled pipe and conduit entries, and they could be installed at any location on the sump's base wall.

After years of improvements made to containment sumps such as ease of installation, height adjustability, and increased liquid-tight seals at the base to tank connection, riser to base connection and the pipe and conduit entry connections, there is but one leakage source problem with which to contend. The access cover has proven to be a major source of water infiltration in high ground water installations.

Recent solutions to this problem have been to install a rubber seal to the top outside circumference of the riser section. Placing the larger diameter overlapping cover over this riser, with a rubber seal installed, provided only a limited amount of sealing protection. Another access cover sealing method using a number of rubber top latches to hold the cover down compressing an O-ring seal, has also proven ineffective. More recently a newly designed sump was introduced to the market which features a bolt-down access cover configuration using metal fasteners and a rubber O-ring. This method of sealing has proven to be effective but requires two flanges: one outwardly facing flange on the bottom of the access cover; and one inwardly facing flange on the top of the riser section. The disadvantage of this type of sump/access cover arrangement is that it is time consuming to remove and replace all of these fasteners each time entry is made into the containment sump. Another problem with this type of sump/access cover arrangement is that the riser section is no longer height adjustable because of the required inwardly facing flange located at the top of the riser section.

A new and improved solution to the problem of leaking containment sump access cover is stated in the description of the following invention.

SUMMARY OF THE INVENTION

With the foregoing in mind, it is the object of the present invention to provide a new and improved cover assembly for pump access sumps which truly provides a hermetic seal under even the most adverse use conditions. The seal also effectively compensates for normal warpage of the cover and riser resulting from the manufacturing process. The cover and seal assembly are characterized by novel features of construction and arrangement providing a positive radial and axial sealing force between the cover and the riser, irrespective of variations in specification and concentricity between the skirt of the cover and the riser. To this end, the cover includes a circumferentially extending downwardly open outer annular channel which overlies and circumscribes the axial end portion of the upper end of the riser and which houses a ring like sealing element which is press fitted in the outer channel and snugly engages over the upper terminal axial end of the riser. The cover further includes an inner circumferentially extending upwardly open annular channel for a ring-like compression ring. The inner and outer channels are located side by side so that the combination of seal and compression rings produces an effective radial and axial seal between the cover and the riser.

The riser is of dome shaped configuration to direct any water to the outer periphery of the cover from where it is deflected outwardly away from the riser by the out turned outer edge of the cover defining the outer pocket.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
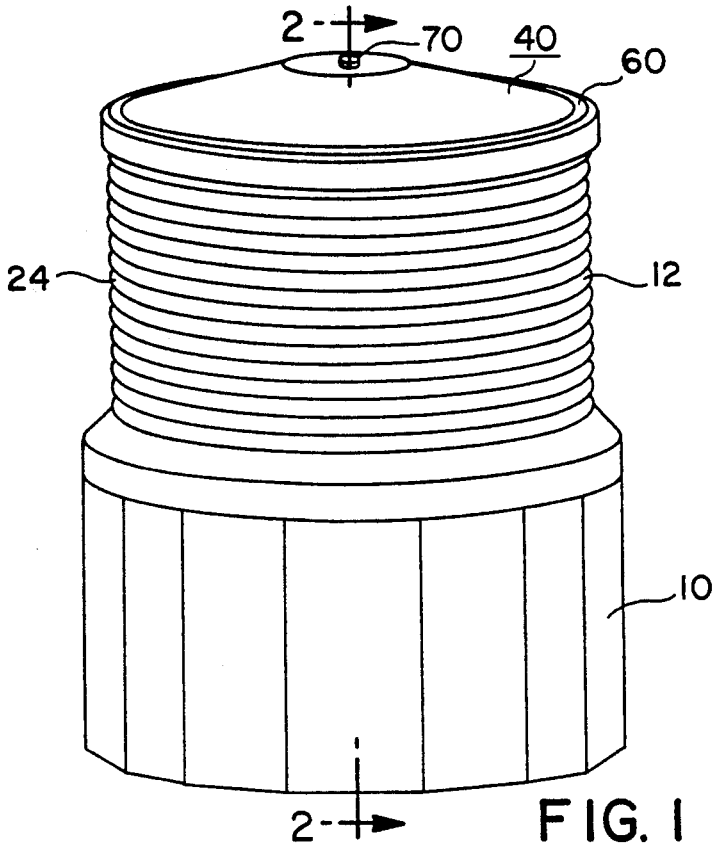
FIG. 1 is a perspective view of an access sump assembly incorporating a sump cover made in accordance with the present invention.
Figure 2:
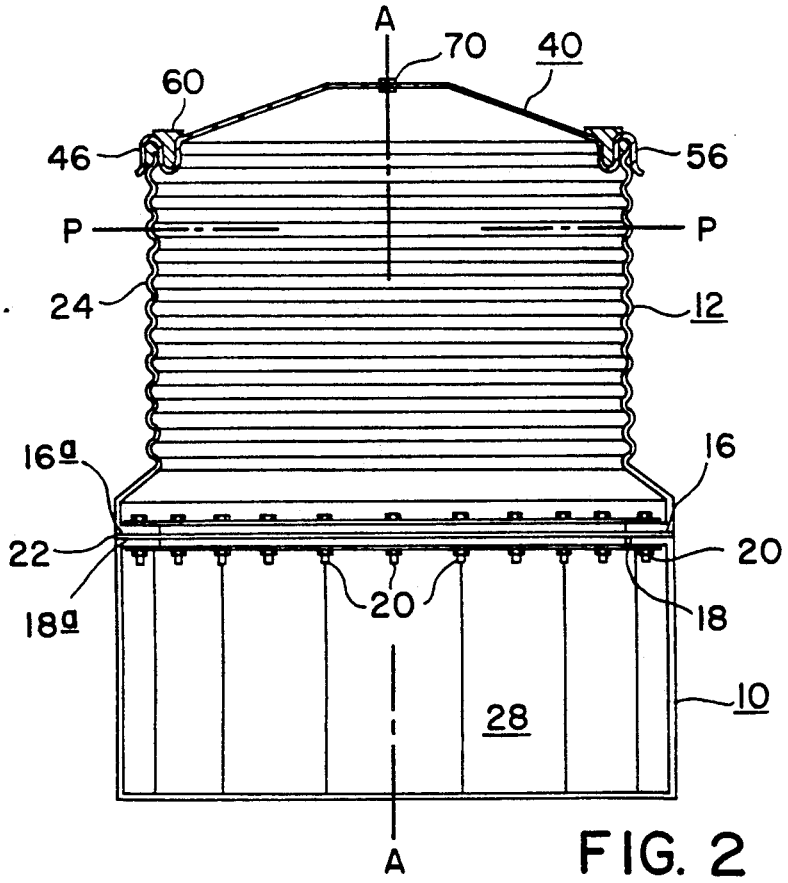
FIG. 2 is transverse sectional view of the sump assembly taken on lines 2—2 of FIG. 1.
Figure 3:
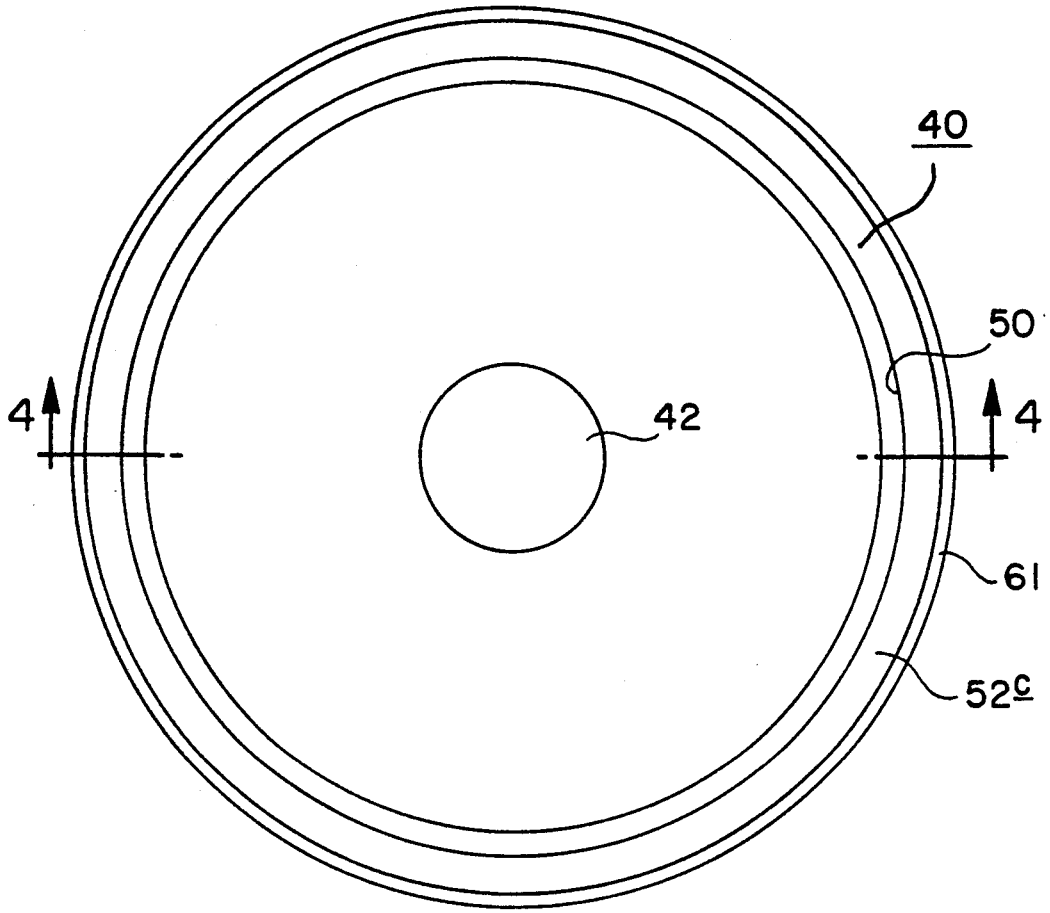
FIG. 3 is a top plan view of the sump cover.
Figure 7:
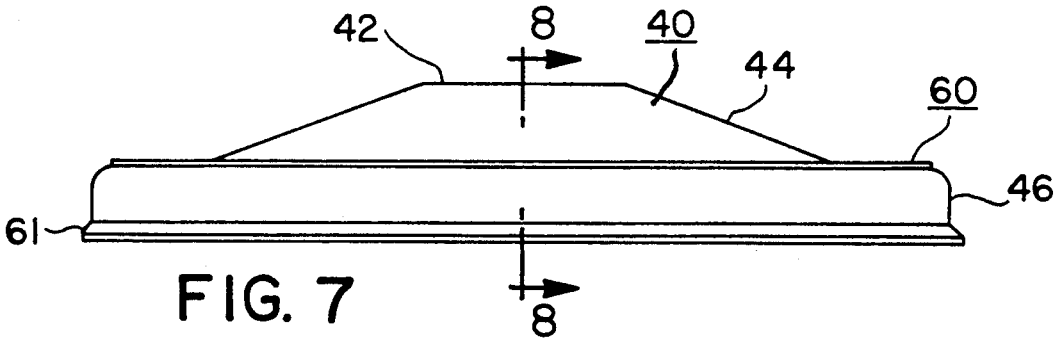
FIG. 7 is a side elevational view of a cover made in accordance with the present invention.

Referring now to the drawings and particularly to FIGS. 1 and 2 thereof, there is illustrated a sump assembly including a sump cover 40 in accordance with the present invention. The sump assembly as illustrated comprises a base 10 and an upstanding riser section 12 detachably mounted at its lower end to the base 10. In the present instance, the riser and base sections have complementary radially inwardly directed flanges 16 and 18, respectively, which are secured by a series of circumferentially spaced bolts 20 mounting a seal 22 between the confronting faces $16^a$, $18^a$ of the respective flanges 16, 18. The riser section 12 has an accordion shaped side wall 24 to facilitate trimming the riser as necessary along a horizontal plane P—P generally perpendicular to the axis A—A of the sump. The sump chamber 28 houses equipment, such as pumps and piping connecting the pumps through the base 10 to a supply tank or the like. The sump is usually mounted below grade and is usually surrounded by a manhole sleeve closely circumscribing the top of the riser section 12 and a conventional manhole cover for access to the sump and its contents.

Figure 4:
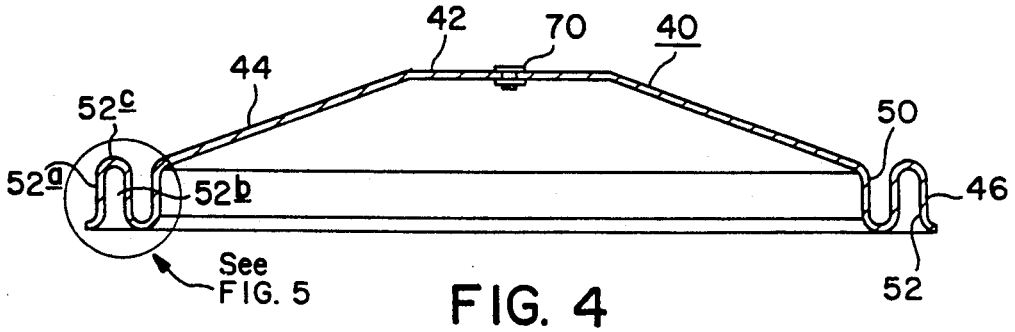
FIG. 4 is a transverse cross sectional of the cover taken on lines 4—4 of FIG. 3.
Figure 5:
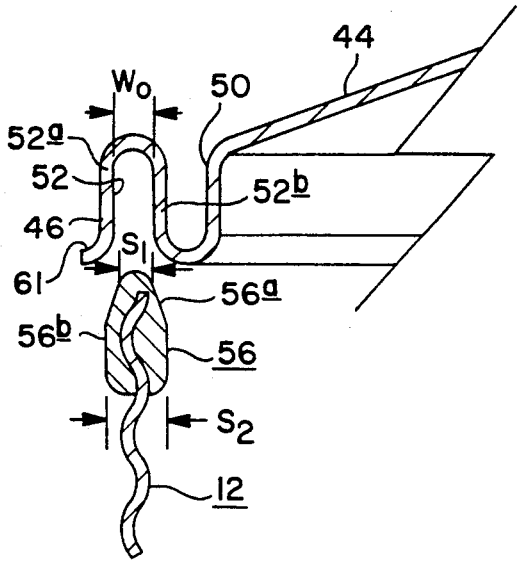
FIG. 5 is a fragmentary sectional view showing the riser seal in the relaxed state prior to assembly of the cover.
Figure 6:
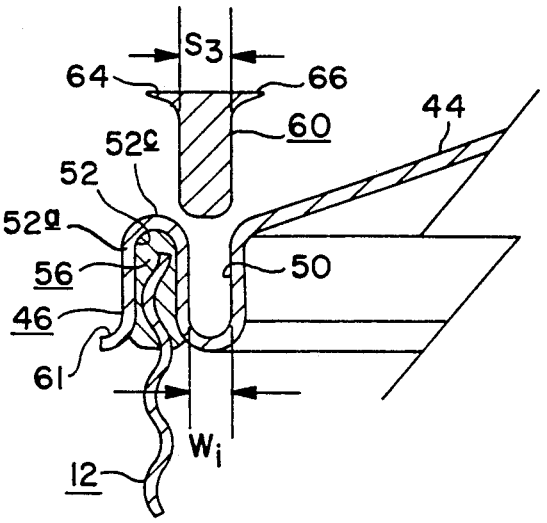
FIG. 6 is a fragmentary sectional view of the compression filler in the relaxed state prior to assembly in the inner channel of the cover.

In accordance with the present invention, the sump cover 40 is characterized by novel features of construction and arrangement providing an effective seal with the riser section 12 which compensates for warpage or out-of-roundness of the cover 40 and riser section 12 and provides a liquid tight seal under the most adverse conditions and environment. To this end, as best illustrated in FIGS. 4, 5 and 6, the cover 40 comprises a generally flat disk like top 42 having a downwardly diverging frusto conical top section 44 extending from the outer peripheral edge of the disk like top 42 terminating at its outer periphery in a skirt section 46. The skirt section 46 is, in the present instance, of generally serpentine, sinusoidal cross-section defining concentric side by side inner and outer channels 50 and 52 respectively. The inner channel 50 opens axially upwardly and the outer channel 52 opens axially downwardly.

A riser seal in the form of a ring 56 fits over the upper end of the riser section 12 and is secured thereto by suitable fastening means, such as an adhesive, and is of a shape to snugly engage in the downwardly depending outer channel 52 of the cover 40 when the cover is assembled to the riser section 12 in the manner shown in FIGS. 5, 6, 8 and 9. To this end, the riser seal 56 has a tapered nose section $56^a$ of a cross-section $S_1$ which is smaller than the transverse width $W_O$ of the U-shaped outer channel 52, and an enlarged body portion $56^b$ having a cross section $S_2$ greater than the transverse width $W_O$ of the downwardly depending outer channel 52. The tapered nose section $56^a$ acts as a pilot to center the cover during the assembly process and facilitate easy application to a fully seated position (see FIGS. 6, 8 and 9). It is noted that the axial walls $52^a$, $52^b$ defining the outer channel 52 flex, permitting snug entry of the riser seal 56 when applying the cover 40 over the riser section 12 and provide a large surface conformity and seal area between the riser seal 56 and the interior surface of the outer channel 52. It is noted that the length of the riser seal 56 is preferably greater than the depth of the outer channel 52 to provide an extended seal at the open end of the outer channel 52 in the manner shown in FIG. 9.

Figure 8:
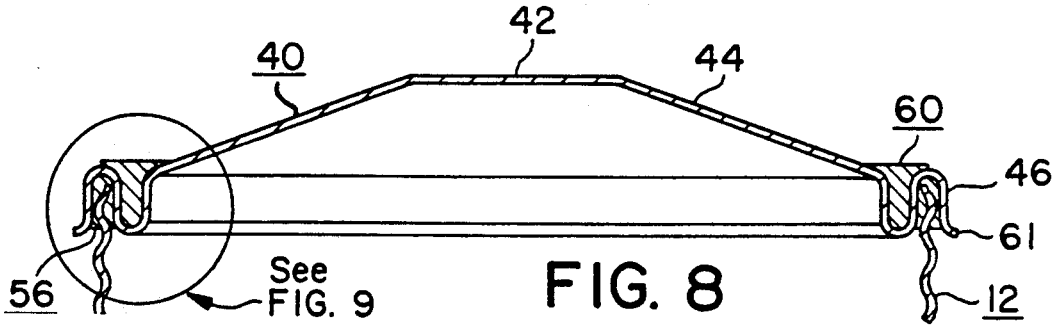
FIG. 8 is a transverse sectional view through the cover showing the cover and seal details taken on lines 8—8 of FIG. 7.
Figure 9:
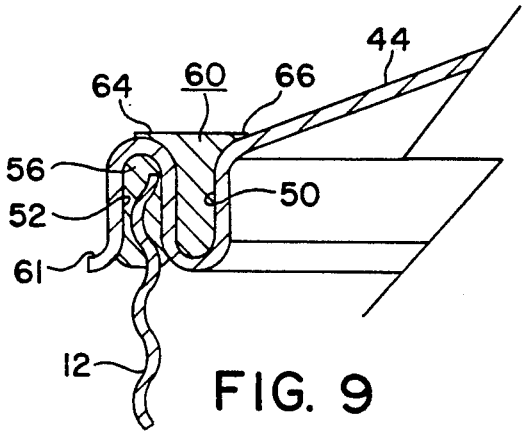
FIG. 9 is a fragmentary sectional view of the circled portion of FIG. 8.

The cover 40 also includes a pressure ring 60 which, after assembly of the cover 40 over the riser seal 56, is pressed into the upwardly facing inner channel 50 in the manner shown in FIGS. 6, 8 and 9 thereby providing an additional positive radial force compressing the riser seal 56 and ensuring a liquid tight seal between the cover 40 and riser section 12 even under extreme internal or ambient pressure changes. As illustrated, the shape of the pressure ring 60 conforms generally to the U-shaped configuration of the inner channel 50 and is of a cross-section $S_3$ slightly greater than the width $W_i$ of the inner channel 50 to provide the compression action described. The top of the pressure ring 60 has outwardly flared upper edges defining a circumferentially extending outer lip 64 which overlies the base $52^c$ of the outer channel 52, and an inner lip 66 which engages beyond the juncture of the frusto conical top section 44 and the inner wall of the inner channel 50 to provide a run off ramp directing any fluids engaging the cover 40 outwardly and down the outer skirt wall $52^a$ of the outer channel 52 which has an outwardly curled terminal edge 61 to direct fluids away from the riser wall.

The disk-like cover 40 includes an air permeable, liquid impervious element 70 which permits breathing, and relieves any pressure or vacuum build-up inside the sump.

The cover 40 of the present invention is easy to apply and remove. With the sump in place within the tight confines of a manhole sleeve, the cover 40 is simply positioned over the riser seal 56 and is pressed downwardly about its skirt section 46 to fully seat the cover 40 over the riser seal 56. The pressure ring 60 is then inserted into the inner channel 50 and is pressed firmly in place to the position shown in FIG. 9. The radial and axial seal provided insures a liquid tight assembly which, as noted above, compensates for any manufacturing out-of-round imperfections or the like and is operable irrespective of variations in pressure conditions in the sump chamber 28 or the ambient environment. The undulating serpentine configuration of the skirt section 46 of the cover 40 provides a certain rigidity, and it has been found that it is more concentric and less prone to out-of-round deviations in the manufacturing process as compared with the prior covers which simply have a single downwardly extending peripheral wall defining the skirt of the cover.

Even though a particular embodiment of the present invention has been illustrated and described herein, it is not intended to limit the invention and changes and modifications may be made therein within the scope of the following claims.

What is claimed is:

1. A cover for a sump assembly including a riser section of generally tubular configuration comprising:

a top section;

a skirt section depending from the outer periphery of said top section;

means defining a pair of side by side circumferentially extending inner and outer channels in said skirt section which open in opposite axial directions, said outer channel engagable over a seal mounted on an outer axial end of said riser;

a compression ring engagable in said inner channel having a cross section generally conforming to said inner channel and of a larger width than the width of said inner channel to provide a press fit therein and produce radially directed sealing forces between the cover and riser section, said compression ring having radially directed inner and outer lips which overly a portion of said top section and a base portion of the outer channel.

2. A cover as claimed in claim 1, wherein said skirt section is of undulating generally S-shaped cross section which defines an inner upwardly open channel of generally U-shaped cross-section and an outer downwardly open channel of generally U-shaped cross-section.

3. A cover as claimed in claim 1 wherein said top section comprises a disk-like central portion and a downwardly diverging frusto conical annular portion between said central disk portion and said skirt section.

4. A cover as claimed in claim 3 further including air permeable, liquid impervious means in said central disk to relieve pressure and avoid formation of a vacuum in the sump chamber.

5. In a sump assembly;

a riser section of generally tubular configuration having an upstanding annular rim at one end defining an opening;

a cover for sealing the opening in the riser comprising a top section;

a skirt section depending from the outer periphery of said top section;

said skirt section being of a configuration defining at least one channel;

a seal mounted over the annular rim of the riser having a portion extending exteriorly of the rim and a portion extending interiorly of the rim; and said seal having a beveled pilot portion of a cross sectional dimension less than the width of said at least one channel and a body portion of a cross sectional dimension greater than the width of said at least one channel whereby the walls defining said at least one channel exert internal and external radial pressure on said seal portions extending interiorly and exteriorly, respectively, and thereby provide a substantially uniform sealing pressure about the periphery of the cover.

6. A cover as claimed in claim 5, said skirt section further including a second channel wherein said skirt section is of a configuration defining a pair of side by side circumferentially extending channels, wherein said at least one channel and said second channel open in opposite axial directions, and further including a compression ring engagable in said second channel to produce radially directed sealing forces between said cover and riser section, wherein said skirt section is of an undulating, generally S-shaped cross section wherein said at least one channel and said second channel define an inner upwardly open channel of generally U-shaped cross-section and an outer downwardly open channel of generally U-shaped cross section, respectively.

7. A cover as claimed in claim 6 wherein said compression ring has a body portion of a cross-section generally conforming to said inner channel, and is of larger width than the width of said inner channel to provide a press fit therein and having radially directed inner and outer lips to overlie a portion of the top and a base portion of said adjacent outer channel.

8. A cover as claimed in claim 5 wherein said top section comprises a disk-like central portion and a downwardly diverging frusto conical annular portion between said central disk portion and said skirt section.

9. A cover as claimed in claim 8 further including air permeable, liquid impervious means in said disk like central portion to relieve pressure and avoid formation of a vacuum in the sump chamber.

* * * * *